US009404254B2

(12) United States Patent
Reigstad

(10) Patent No.: US 9,404,254 B2
(45) Date of Patent: Aug. 2, 2016

(54) POST-TENSION CONCRETE LEAVE OUT SPLICING SYSTEM AND METHOD

(71) Applicant: REIGSTAD & ASSOCIATES, INC., Saint Paul, MN (US)

(72) Inventor: Gordon H. Reigstad, Saint Paul, MN (US)

(73) Assignee: Reigstad & Associates, Inc., Saint Paul, MN (US)

( * ) Notice: Subject to any disclaimer, the term of this patent is extended or adjusted under 35 U.S.C. 154(b) by 0 days.

(21) Appl. No.: 14/581,715

(22) Filed: Dec. 23, 2014

(65) Prior Publication Data

US 2015/0176277 A1 Jun. 25, 2015

Related U.S. Application Data

(60) Provisional application No. 61/920,580, filed on Dec. 24, 2013.

(51) Int. Cl.
*E04B 5/32* (2006.01)
*E04C 5/16* (2006.01)

(52) U.S. Cl.
CPC ..... *E04B 5/32* (2013.01); *E04B 2005/324* (2013.01); *E04B 2103/02* (2013.01); *E04C 5/165* (2013.01)

(58) Field of Classification Search
CPC ..... E04C 5/162; E04C 5/163; E04C 5/165; E04C 5/168; E04C 5/0645; E04B 1/06; E04B 1/043; E04B 1/22; E04B 5/023; E04B 5/32; E04B 2005/324; E04B 2103/02; E04B 5/04
USPC ..... 52/223.6, 223.7, 583.1, 742.14, 742.16, 52/223.8, 223.9, 223.11, 223.13, 223.14
See application file for complete search history.

(56) References Cited

U.S. PATENT DOCUMENTS

| | | | | | |
|---|---|---|---|---|---|
| 2,181,623 | A | | 11/1939 | Klein | |
| 2,611,262 | A | * | 9/1952 | Dodson et al. | 52/223.13 |
| 3,295,286 | A | | 1/1967 | Schaich | |
| 3,369,334 | A | * | 2/1968 | Berg | 52/223.13 |
| 3,478,481 | A | * | 11/1969 | Schuppisser et al. | 52/432 |
| 3,555,753 | A | * | 1/1971 | Magadini | 52/223.7 |
| 3,691,708 | A | * | 9/1972 | Firnkas | 52/470 |
| 3,782,061 | A | * | 1/1974 | Minutoli et al. | 52/125.5 |
| 3,869,530 | A | * | 3/1975 | Williams | 264/33 |
| 3,952,468 | A | * | 4/1976 | Soum | 52/223.13 |
| 4,024,688 | A | | 5/1977 | Calini | |
| 4,099,360 | A | | 7/1978 | Outram | |
| 4,324,081 | A | | 4/1982 | Chicha | |
| 4,627,203 | A | * | 12/1986 | Presswalla | E04B 5/32 174/96 |
| 4,627,212 | A | | 12/1986 | Yee | |
| 4,692,052 | A | | 9/1987 | Yee | |
| 4,695,178 | A | | 9/1987 | Era et al. | |
| 4,781,006 | A | | 11/1988 | Haynes | |
| 4,919,122 | A | * | 4/1990 | Kohlenbrenner | 52/223.7 |
| 5,123,220 | A | * | 6/1992 | Simenoff | 52/252 |
| 5,134,828 | A | | 8/1992 | Baur | |
| 5,305,573 | A | * | 4/1994 | Baumann | 52/848 |

(Continued)

*Primary Examiner* — Joshua J Michener
*Assistant Examiner* — Theodore Adamos
(74) *Attorney, Agent, or Firm* — Hamre, Schumann, Mueller & Larson, P.C.

(57) ABSTRACT

Devices, systems, and methods for constructing post-tensioned concrete slabs in a new floor construction that has a reduced gap distance between the slabs. The devices, systems, and methods can improve project construction time by reducing the time delay in accessing the floor underneath the slabs due to safety and/or weather conditions.

16 Claims, 15 Drawing Sheets

(56) References Cited

U.S. PATENT DOCUMENTS

| | | | | |
|---|---|---|---|---|
| 5,366,672 | A | 11/1994 | Albrigo et al. | |
| 5,606,839 | A | 3/1997 | Baumann | |
| 5,664,902 | A | 9/1997 | Holdsworth | |
| 5,669,196 | A | 9/1997 | Dahl | |
| 5,821,463 | A | 10/1998 | Ngo | |
| 5,909,980 | A | 6/1999 | Holdsworth | |
| 5,974,761 | A | 11/1999 | Mochizuki et al. | |
| 6,065,263 | A * | 5/2000 | Taguchi | 52/583.1 |
| 6,192,647 | B1 | 2/2001 | Dahl | |
| 6,389,774 | B1 | 5/2002 | Carpenter | |
| 6,402,435 | B1 * | 6/2002 | Lewis | E02D 29/0216 405/262 |
| 6,532,711 | B2 | 3/2003 | Gregel et al. | |
| 6,668,412 | B1 | 12/2003 | Tadros et al. | |
| 6,679,024 | B2 | 1/2004 | Dahl | |
| 7,556,208 | B1 * | 7/2009 | Reichel | 238/8 |
| 8,387,328 | B2 * | 3/2013 | Gentil | 52/587.1 |
| 8,413,396 | B2 | 4/2013 | Oliva et al. | |
| 8,636,441 | B2 * | 1/2014 | French | 404/45 |
| 8,904,721 | B2 | 12/2014 | Pantelides et al. | |
| 2004/0238558 | A1 | 12/2004 | Frohlich | |
| 2005/0072103 | A1 | 4/2005 | Hopwood | |
| 2005/0169701 | A1 | 8/2005 | Kies et al. | |
| 2006/0067785 | A1 | 3/2006 | Holdsworth | |
| 2006/0137115 | A1 * | 6/2006 | Park | E01D 2/02 14/74.5 |
| 2007/0095013 | A1 | 5/2007 | Kerkay | |
| 2008/0060291 | A1 | 3/2008 | Braun | |
| 2009/0263189 | A9 * | 10/2009 | Koivunen | 403/379.4 |
| 2011/0099941 | A1 * | 5/2011 | Yegge | E04C 3/26 52/831 |

* cited by examiner

POST-TENSION CONCRETE LEAVE OUT SPLICING SYSTEM AND METHOD

FIELD

This description relates generally to floor construction using post-tensioned concrete slabs.

BACKGROUND

Generally, a process for new floor construction using post-tensioned concrete slabs requires a gap (also known as a leave out, a pour strip out, etc.) that separates adjacent concrete slabs (also known as pours or castings). Generally, the gap is four feet and more in length. That is, several feet in distance separates the two ends of the post-tensioned concrete slabs. Sometimes the gap distance (the distance which separates the two ends of the post-tensioned concrete slabs) may be called a "width," but for clarity and consistency, the term "width" is used herein to describe the distance along the direction labeled "W," and the term "length" is used herein to describe the distance along the direction labeled "L" (e.g., see FIGS. 1-3). Accordingly, ΔL is used herein to describe a change in distance along the "L" axis direction. Generally, the gap is filled in (i.e., lap spliced) with a pour strip at a later time, connecting the slabs together to form the entire floor.

Prestressed concrete is a type of reinforced concrete which has been subjected to external compressive forces prior to the application of load. Prestressed concrete is categorized as either pre-tensioned or post-tensioned.

Pre-tensioned concrete is formed by a process including initial stressing of a wire strand system and then casting concrete around the stressed wire strand system. The stress from the wire strand system transfers to the concrete after the concrete has reached a specified strength (e.g., cured to a set specification).

Post-tensioned concrete is formed by a process of casting wet concrete around an unstressed wire strand system and then stressing the wire strand system after the concrete has reached specified strength (e.g., cured to a set specification). For example, post-tensioned concrete can have a wire strand system which has a wire enclosed in a duct (e.g., pipe, conduit, etc.). Concrete is formed around the duct and the concrete sets and cures. Then, the wire is stressed and grout material (e.g., a mixture of cement, sand, aggregate, and water) is pumped into the cavity surrounding the wire. The grout material bonds the wire to the duct, and the duct is bonded to the cured concrete. Thus, the stress applied to the wire can be transferred to the concrete. The applied stress (e.g., forces applied to the wire strand system) in the post-tensioning process causes a volume change (and/or a length change) to the concrete material. The volume change of the concrete material causes a change in the length of the concrete slab. The length change is a shortening in the direction parallel to applied stress (e.g., the post-tensioning force).

FIGS. 1-2 show schematic diagrams of a floor construction 10 according to a generally known process using post-tensioned concrete. FIG. 1 shows a top-down plan view of the floor construction 10. The floor construction 10 includes post tensioned slabs 12, 14 separated by a gap 16. FIG. 1 shows the "width" direction indicated by "W" and the "length" direction indicated by "L" (FIGS. 2 and 3 also show the length direction indicated by "L"). FIG. 2 shows a side view of the floor construction 10, also showing the slabs 12, 14, and the gap 16. The floor construction 10 is made by a process wherein the post tensioned slabs 12, 14 are each poured separately, tensioned independent of each other after they have sufficiently cured. Thus, the rebars in the post-tensioned slab 12 do not necessarily lineup (e.g., axially) with the rebars in the post-tensioned slab 14.

Each of the slabs 12, 14 changes volume due to their tensioning processes. The typical tensioning process for a typical floor construction uses the gap 16, which is typically four to eight feet in length, for accommodating appropriate tooling and equipment (and also for access by workers) to tension the slabs 12, 14. Further, the gap 16 (i.e., the separation between the two slabs 12, 14) becomes longer (e.g., along direction L shown in FIG. 1) during and after the tensioning of one or both of the slabs 12, 14. That is, the volume changes in the slabs 12, 14 and the slabs 12, 14 become shorter. And because the slabs 12, 14 become shorter, the separation between them, which is the gap 16, becomes longer.

For example, in a typical hotel floor construction, the gap 16 can be about sixty to seventy feet in width and four to eight feet in length. Generally, the gap 16 is left open for twenty to thirty days to allow most of the volume changes (i.e., slab shortening) to occur to the post-tensioned concrete slabs 12, 14. After the twenty to thirty days, the gap 16 is filled in (i.e., lap spliced) with a pour strip 18 to provide a structural continuity of the floor construction 10 required by the final design to resist all required loads.

FIG. 3 shows a close-up schematic view of a portion 20 of the floor construction 10 shown in FIG. 2. The portion 20 shows the first slab 12 having a post-tensioning wire strand system 22 for stressing the concrete 23. The slab 12 includes a steel reinforcing bar 24 (also known as rebar) which reinforces the concrete 23 in the slab 12. Generally, the rebar 24 and other rebar in the slab 12 are somewhat regularly positioned in the slab 12, and extend out from the end of the slab 12 towards the gap 16. The second slab 14, which is also shown in the portion 20, has its own post-tensioning wire strand system 26 for stressing the concrete 27. The slab 14 includes a rebar 28 which reinforces the concrete 27 in the slab 14. Generally, the rebar 28 and other rebar in the slab 14 are somewhat regularly positioned in the slab 14, and extend out from the end of the slab 14 towards the gap 16. In the prior art process of forming the floor construction 10, the positioning of the rebar 28 is not based on or with respect to the position of the rebar 24. Further, prior to the filling in of the gap 16 with the pour strip 18, the rebar 24 extending out from the slab 12 is not connected to the rebar 28 extending out from the slab 14. That is, prior to the filling in of the gap 16 with the pour strip 18, the rebar 24 extending out from the slab 12 is not directly connected to the rebar 28 extending out from the slab 14. That is, prior to the filling in of the gap 16 with the pour strip 18, the rebar 24 extending out from the slab 12 is not indirectly connected to the rebar 28 extending out from the slab 14. Other rebar (s) 30 is(are) positioned, or laid down, inside the gap 16 along the width direction, so that the other rebar(s) 30 is(are) perpendicular to the length direction of the rebar 24 and/or 28. Then, the pour strip 18 is formed around the rebar 24, 28, 30 filling in the gap 16.

Referring back to FIG. 1, in a multi-level building construction having one or more floors, the floor construction 10 can be placed above another floor. These floors are connected to and accessible via a construction elevator 30. Generally, there is only one (or very few) construction elevator 30 that is used during the construction of the building. Accordingly, during the construction of the floor construction 10, the slab 12 area can be accessed via the elevator 30. However, the slab 14 area cannot be accessed easily when a gap 16 four feet and more exists between the slabs 12, 14. That is, construction equipment cannot easily be moved to slab 14 from slab 12. Thus, generally, the construction process requiring access to slab 14 waits the twenty to thirty days until the pour strip 18 is poured to splice the slabs 12, 14 together. Further, the gap 16 allows significant weather conditions to intrude into the floor beneath the floor construction 10. Such weather conditions can also prevent work from being performed in the floor underneath the floor construction 10. Despite these disadvantages of having long gaps in post-tension concrete construction, waiting and time delay are generally an accepted part of the-process in the field of construction.

BRIEF SUMMARY

Devices, systems, and methods for connecting post-tensioned concrete slabs in new floor construction reduce the distance (e.g., length) of the gap between the post-tensioned concrete slabs as compared to conventional construction. Accordingly, the devices, systems, and methods disclosed herein advantageously reduce project construction time by reducing the time delay in accessing the floor underneath the slabs due to, for example, safety and/or weather conditions.

An embodiment of concrete construction (e.g., a new floor construction) includes a first post-tensioned concrete slab and a second post-tensioned concrete slab, said first post-tensioned concrete slab and said second post-tensioned concrete slab having respective upper surfaces that are generally aligned, said first post-tensioned concrete slab including a first rebar installed therein, said second post-tensioned concrete slab including a second rebar installed therein, said first post-tensioned concrete slab and second post-tensioned concrete slab being separated by a gap so that the concrete material of said first post-tensioned concrete slab is not in contact with the concrete material of said second post-tensioned concrete slab, said construction comprises a splice device positioned in the gap splicing together a portion of the first rebar and a portion of the second rebar.

In an embodiment of the concrete construction, said splice device includes a cavity that contains said end portion of the second rebar. In an embodiment of the concrete construction, said cavity also contains said end portion of the first rebar. In an embodiment of the concrete construction, said cavity does not contain said end portion of the first rebar. In an embodiment of the concrete construction, said splice device is connected to said end portion of the first rebar. In an embodiment of the concrete construction, said splice device is connected to said end portion of the first rebar at an end of said splice device, wherein said end has a threaded surface which mates with a threaded surface of said end portion of the first rebar. In an embodiment of the concrete construction, said splice device is connected to said first rebar by a weld. In an embodiment of the concrete construction, said splice device is connected to said second rebar by a weld. In an embodiment of the concrete construction, the concrete material of said first post-tensioned concrete slab is not in contact with the concrete material of said second post-tensioned concrete slab.

In another embodiment of the concrete construction, the gap has a longer dimension for one side-to-side and a shorter dimension for another side-to-side, the shorter dimension (e.g., along the "L" direction of the floor construction shown in FIG. 4) being three feet or less, preferably two feet or less, or more preferably twelve (12) inches or less along the length. In all of the embodiments, the minimum distance of the gap that can be achieved is the length of the splice device used in the gap.

In an embodiment of the concrete construction, said splice device splices together the first rebar and the second rebar so that said first rebar and the second rebar are parallel with each other. In an embodiment of the concrete construction, said splice device splices together the first rebar and the second rebar so that said first rebar and the second rebar are inline.

In an embodiment of the concrete construction, a strip of non-shrink material is placed in the gap, wherein said strip has a compressive strength that is greater than or equal to the compressive strength of the concrete material of said first post-tensioned concrete slab and/or the concrete material of said first post-tensioned concrete slab.

In an embodiment of the concrete construction, the strip of non-shrink material completely surrounds the splice device. In an embodiment of the concrete construction, the strip has a longer dimension for one side-to-side and a shorter dimension for another side-to-side, the shorter dimension (e.g., along the "L" direction of the floor construction shown in FIG. 4) being three feet or less, preferably two feet or less, or more preferably twelve (12) inches or less along the length. In all of the embodiments, the minimum distance of the strip that can be achieved is the length of the splice device used in the gap, and covered by the strip.

In an embodiment of a method for making a concrete construction including a first post-tensioned concrete slab and a second post-tensioned concrete slab separated by a gap, the method comprises forming said first post-tensioned concrete slab, wherein said first post-tensioned concrete slab includes a first rebar installed therein; prior to pouring a second concrete slab, positioning a second rebar for said second concrete slab so that a portion of said second concrete slab is generally in line with a portion of said first rebar; pouring said second concrete slab; forming a second post-tensioned concrete slab by tensioning said second concrete slab, thus forming said gap between said first post-tensioned concrete slab and said second post-tensioned concrete slab, wherein said gap has a longer dimension for one side-to-side and a shorter dimension for another side-to-side; positioning a splice device to contact both a portion of said first rebar and a portion of said second rebar; and securely connecting said splice device to said end portion of said second rebar.

In an embodiment of the method for making a concrete construction including a first post-tensioned concrete slab and a second post-tensioned concrete slab, the method comprises forming said first post-tensioned concrete slab, wherein said first post-tensioned concrete slab includes a first rebar installed therein; before a second post-tensioned concrete slab has been formed, positioning a splice device at an end portion of the first rebar, but not securely connecting said splice device to an end portion of the first rebar; before the second post-tensioned concrete slab has been formed, positioning an end portion of a second rebar inside a chamber of said splice device, but not securely connecting said splice device to an end portion of the second rebar; forming said second post-tensioned concrete slab so that said second rebar is installed therein, wherein said first post-tensioned concrete slab and second post-tensioned concrete slab are separated by a gap so that the concrete material of said first post-tensioned concrete slab is not in contact with the concrete material of said second post-tensioned concrete slab, and said end portion of said second rebar is allowed to move with respect to the splice device during the creating of said second post-tensioned concrete slab; and securely connecting said splice device to said end portion of said first rebar and said end portion of said second rebar.

In another embodiment of the method, said gap is formed so that the gap has a longer dimension for one side-to-side and a shorter dimension for another side-to-side, the shorter dimension (e.g., along the "L." direction of the floor construction shown in FIG. 4) being three feet or less, preferably two feet or less, or more preferably twelve (12) inches or less along the length.

In an embodiment of the method, the process further includes forming a strip of material in said gap with a non-shrink material, wherein said strip has a compressive strength that is greater than or equal to the compressive strength of the concrete material of said first post-tensioned concrete slab and/or the concrete material of said first post-tensioned concrete slab.

DETAILED DESCRIPTION

Figure 1:
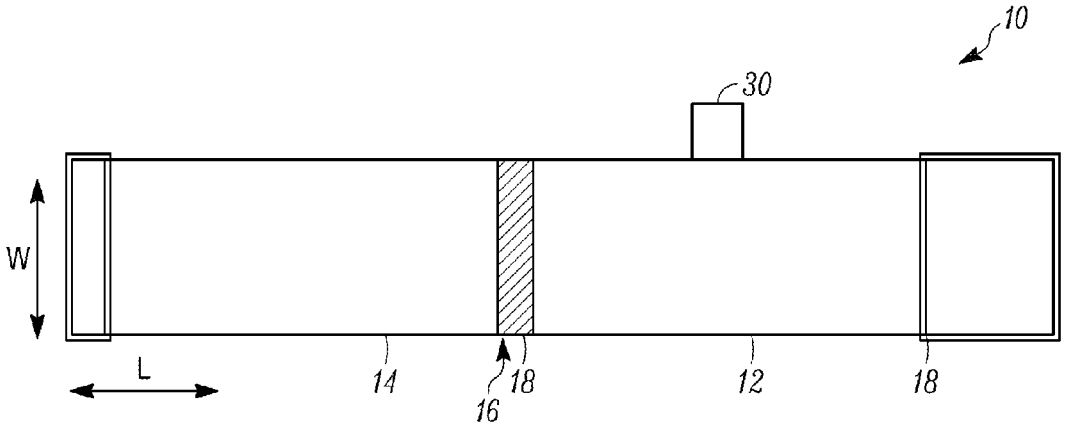
FIG. 1 (PRIOR ART)
FIGS. 1-2 show plan and elevation schematic diagrams, respectively, of a floor construction according to a generally known process using post-tensioned concrete.
Figure 2:
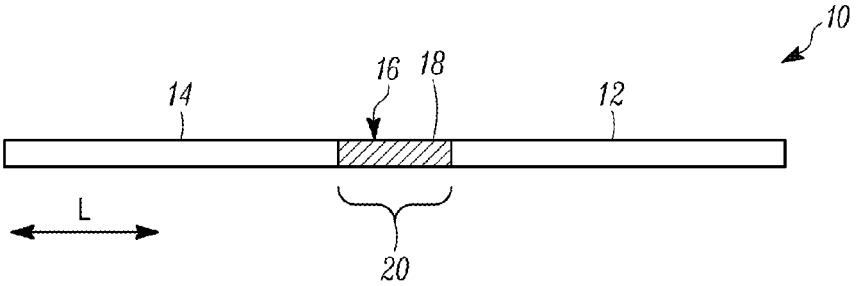
FIG. 2 (PRIOR ART)
Figure 3:
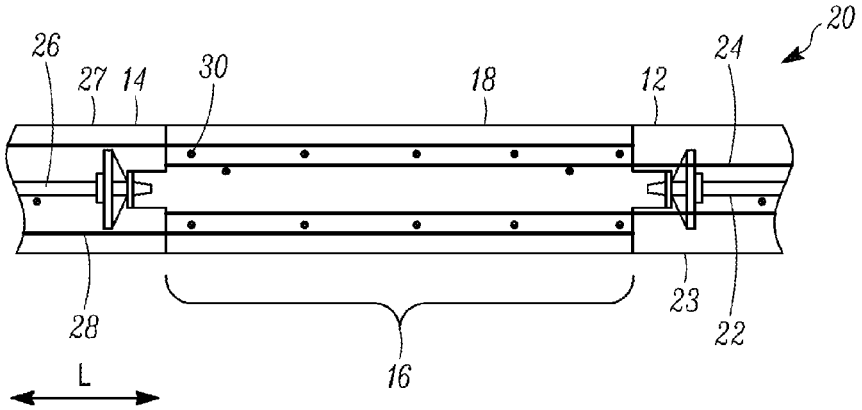
FIG. 3 (PRIOR ART)
FIG. 3 shows an enlarged, elevational schematic view of a portion of the floor construction shown in FIG. 2.

The present disclosure may be further understood with reference to the following description and the appended drawings, wherein like elements are referred to with the same reference numerals. Systems, methods, and devices disclosed herein are directed towards reducing the gap between post-tensioned concrete slabs in a floor construction, so that time delay caused by the existence of conventional gaps in the floor construction can be reduced and/or eliminated.

Figure 4:
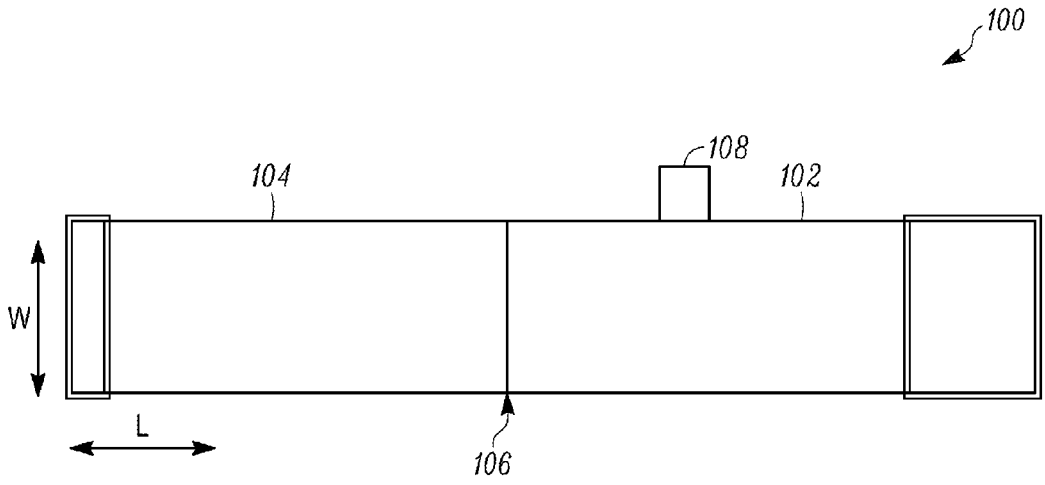
FIGS. 4-5 show plan and elevation schematic diagrams, respectively, of a floor construction according to an embodiment of the present invention.
Figure 5:
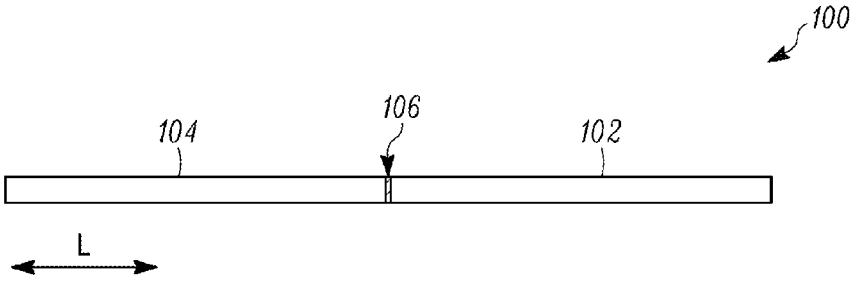

FIGS. 4-5 show schematic diagrams of a floor construction 100 according to an embodiment. FIG. 4 shows the "width" direction indicated by "W" and the "length" direction indicated by "L" (FIGS. 5-7, 9-14, 16-20, and 21 also show the length direction indicated by "L"). The floor construction 100 includes post-tensioned concrete slabs 102, 104. FIG. 4 shows a top-down plan view of the floor construction 100. The floor construction 100 includes post tensioned slabs 102, 104 separated by a gap 106. FIG. 5 shows a side view of the floor construction 100, also showing the slabs 102, 104, and the gap 106. The distance of the gap 106 is substantially less than the conventional gap. For example, it is possible that the gap 106 is less than three feet in distance. In a preferred embodiment, the gap 106 is a foot or less in distance. In all of the embodiments, the minimum distance of the gap 106 is the length of the splice device (e.g., 206 shown in FIG. 7) because the splice device must be placed in the gap 106.

Accordingly, the floor construction 100 can advantageously reduce the overall construction time of the construction project associated with the floor construction 100, because the time delay in accessing the floor underneath the floor construction 100 due to, for example, safety and/or weather conditions, is substantially reduced or eliminated. Further, in a multi-level building construction having one or more floors, the floor construction 100 can be placed above another floor. These floors are connected to and accessible via a construction elevator 108. Accordingly, during the construction of the floor construction 100, the slab 104 area can be accessed via the elevator 108 because the gap 106 has a distance that is small (or short) enough that the gap 106 can be crossed over, and/or the gap 106 can be covered with small piece of material such as, for example, a sheet of metal or a plank of wood, to serve as a short bridge between the slabs 102, 104. Accordingly, the construction equipment can be easily moved between slab 104 and slab 102. Thus, the generally required twenty to thirty day waiting period for accessing areas of the floor that cannot be reached due to the conventional gap (16 shown in FIG. 1) can be eliminated. In a multi-level building construction and/or very large building construction having large square footage floors, the reduction or elimination of the twenty to thirty day waiting period per gap compounds to an enormous reduction in the overall construction time required for the project.

Further, the gap 106 can substantially reduce or prevent weather conditions to intrude into the floor beneath the floor construction 100. Thus, weather conditions no longer prevent work from being performed in the floor underneath the floor construction 100. Therefore, waiting and time delay associated with weather conditions can be reduced or eliminated from the construction process.

Figure 6:
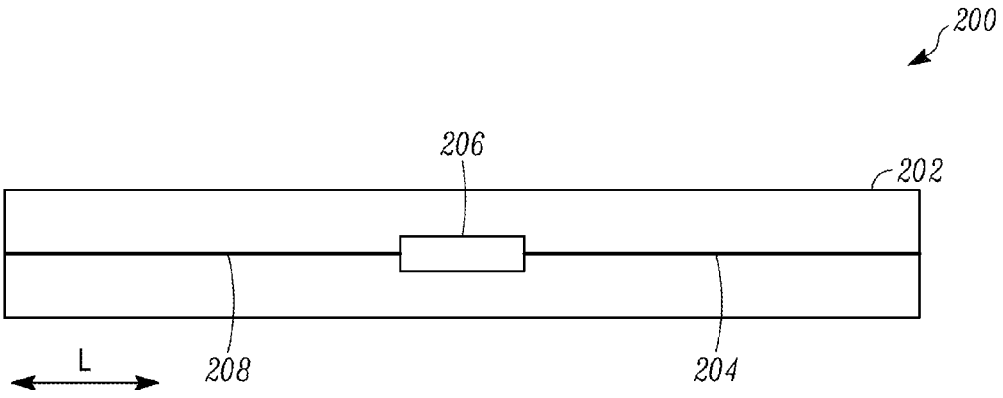
FIG. 6 shows a schematic side view of a floor construction according to an embodiment of the present invention.

FIG. 6 shows a schematic side view of a floor construction 200 according to an embodiment. The floor construction 200 includes a floor 202 formed by joining two post-tensioned concrete slabs with a pour strip filled into a gap between the two post-tensioned concrete slabs. The first post-tensioned concrete slab includes at least one rebar 204 that is fixed with respect to a splice device 206. Preferably, the splice device 206 is less than a foot in length. The second post-tensioned concrete slab includes another rebar 208 that is fixed with respect to the splice device 206. The rebars 204, 208 can be aligned substantially parallel with each other and/or aligned to be continuous along the length (axial) direction. Although not shown in the schematic view, it will be understood that the floor construction 200 can include a plurality of rebars in the first post-tensioned concrete slab, wherein each of the rebars is fixed with respect to splice devices. Further, a plurality of rebars in the second post-tensioned concrete slab are each fixed with respect to the respective splice device, so that each splice device fixes a rebar of the first post-tensioned concrete slab with respect to a rebar of the second post-tensioned concrete slab.

Figure 7:
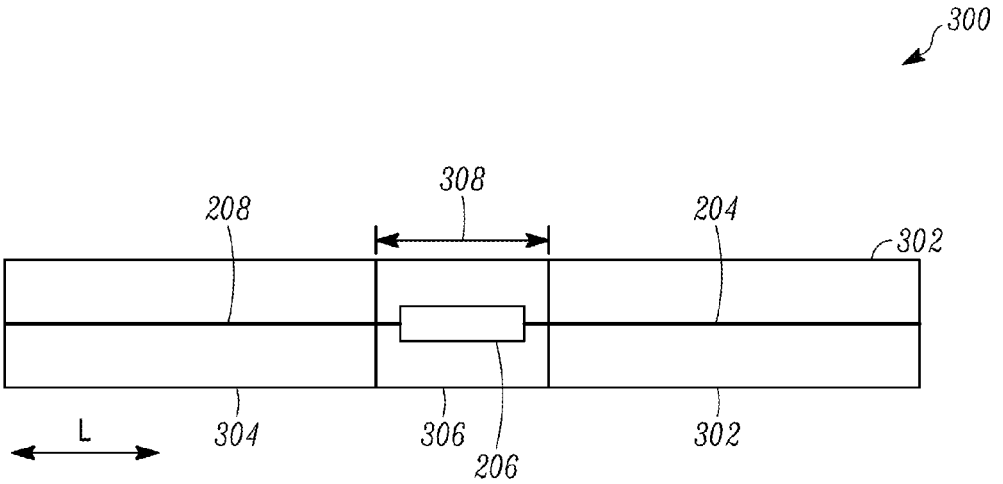
FIG. 7 shows a schematic side view of an embodiment of a floor construction according to an embodiment of the present invention.

FIG. 7 shows a schematic side view of an embodiment of a floor construction 300, which is similar to the floor construction 200 shown in FIG. 6. The floor construction 300 has similar components as the floor construction 200 of FIG. 6. The floor construction 300 includes the first post-tensioned concrete slab 302 and the second post-tensioned concrete slab 304, and the pour strip 306 filled into the gap 308 that is between the two post-tensioned concrete slabs 302, 304. The splice device 206 is positioned in the gap 308, so after the pour strip 306 is used to fill in the gap 308, the splice device 206 becomes surrounded by the pour strip 306.

Figure 8:
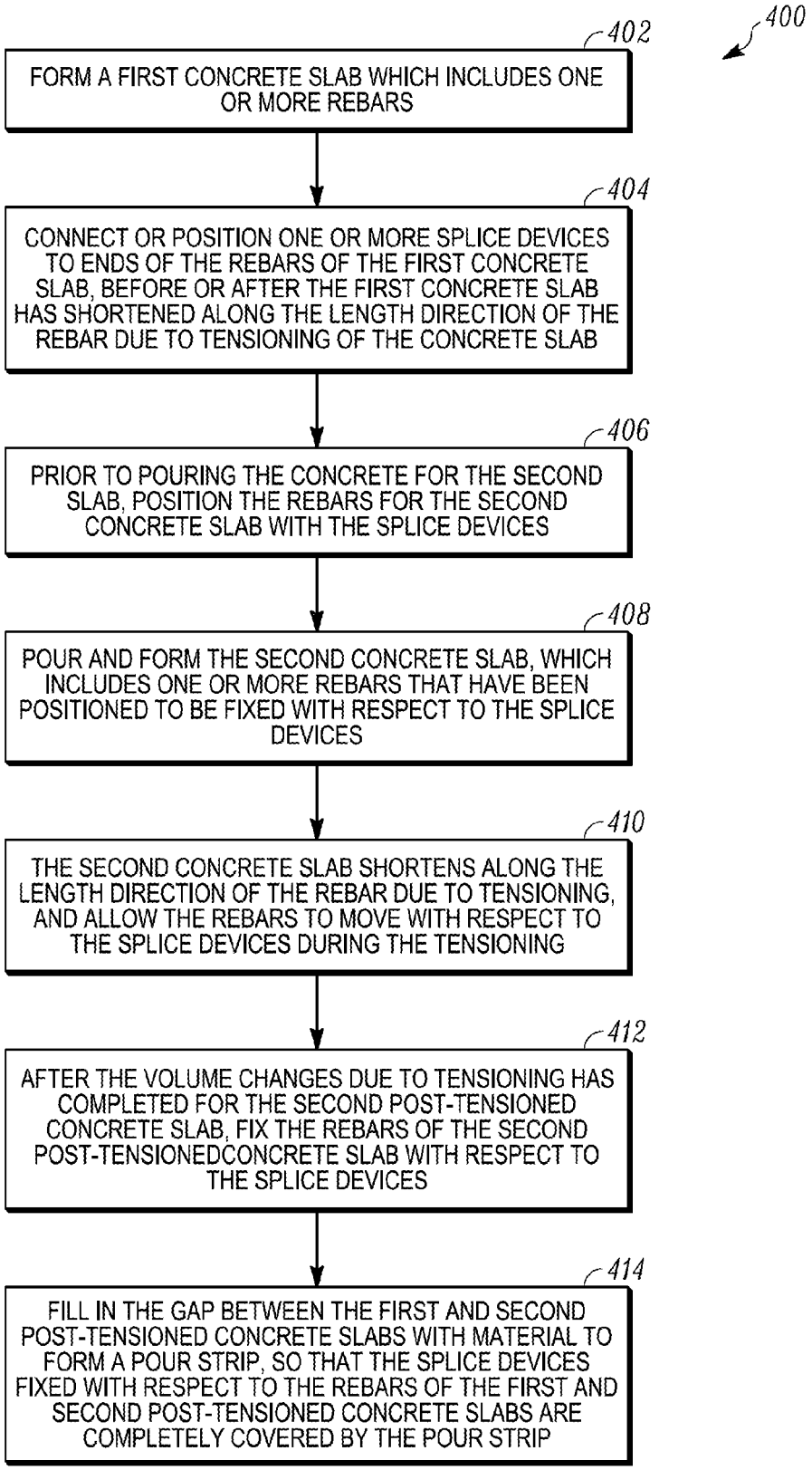
FIG. 8 shows a flow chart of an embodiment of a process for constructing the floor construction with reduced gap design.

FIG. 8 shows a flow chart of an embodiment of a process 400 for constructing the floor construction with reduced gap design. The process includes a step 402 of forming a first concrete slab for post-tensioning, wherein the first concrete slab includes one or more rebars. Ends of the rebars are positioned to extend out from an edge of the first slab. It is preferable that these ends of the rebars do not extend more than six inches beyond the edge of the first slab. The process includes a step 404 of positioning a splice device at the end of the rebar. Preferably, a splice device is positioned at each of the ends of the rebars that are exposed in the gap. The positioning of the one or more splice devices can be done before or after the first concrete slab has shortened along the length direction of the rebar due to tensioning of the concrete slab. If desired, the splice devices can be connected, attached, and/or fixedly secured to the rebars of the first slab at this time. This particular step can depend on the particular features of the splice device used.

The process further includes a step 406 of positioning the rebars for the second concrete slab so that their ends are positioned within respective inner chambers of the splice devices prior to pouring the concrete for the second concrete slab. These rebars are positioned so that they can move with respect to the splice devices. That is, the rebars for the second concrete slab are not secured to the splice devices at this stage of the process. It is preferable that the positioning of the rebars for the second concrete slab with respect to the splice devices are done after the first concrete slab has been tensioned (e.g., using the wire strand system that is included in the first concrete slab) and has gone through the volume change, becoming the first post-tensioned concrete slab. Thus, the positioning of the splice devices and then the positioning of the rebars for the second concrete slab can be done with a desired gap space in mind. That is, after the first post-tensioned concrete slab has formed, the length change along the length direction of the rebars would have been completed. Thus, when the splice devices are attached to the rebars of the first post-tensioned concrete slab, the length of the gap can be estimated and/or substantially determined. It is preferable that this estimated and/or substantially determined gap distance is less than a foot. Further, at this stage in the process 400, the splice devices are positioned where the gap between the first and second concrete slabs will exist when the second concrete slab is formed.

The process includes a step 408 of pouring and forming the second concrete slab. The second concrete slab includes one or more rebars that have been positioned with the splice devices. Then, the second concrete slab is allowed to shorten along the length direction of the rebar by and due to tensioning of a wire strand system in the second concrete slab. Because the rebars for the second concrete slab are not secured to the splice devices during step 410, the rebars can and do move with respect to the splice devices during the tensioning of the second concrete slab.

After the volume changes due to tensioning of the second concrete slab has been completed, the second concrete slab is the second post-tensioned concrete slab. The process 400 includes a step 412 of connecting and/or securing the rebars of the second post-tensioned concrete slab to the splice devices. In addition, if in the step 404 of connecting the splice device to the rebar of the first concrete slab, the splice device was not secured to the rebar of the first concrete slab, then, in step 412, the splice device can be secured to the first rebar of the first post-tensioned concrete slab. Accordingly, in the step 412, both of the first and second rebars of the first and second post-tensioned concrete slabs can be secured (e.g., connected) to the splice device. This particular step can depend on the particular features of the splice device used.

At this stage in the process, the gap between the first post-tensioned concrete slab and the second post-tensioned concrete slab is generally fixed. Accordingly, the gap distance is generally known. The gap distance of three feet or less is possible. Preferably, the gap distance at this stage is one foot or less.

The process 400 includes a step 414 of filling in the gap between the first and second post-tensioned concrete slabs with material to form a pour strip. When the pour strip is formed in the gap, the splice devices connected to the rebars of the first and second post-tensioned concrete slabs are covered by the pour strip. It is preferable that the splice devices positioned in the gap are completely covered by the pour strip.

FIGS. 9-14 show schematic side views of floor constructions 500*a-f*, respectfully, being constructed according to the process 400 described above and shown in FIG. 8. Like elements are referred to with the same reference numerals.

Figure 9:
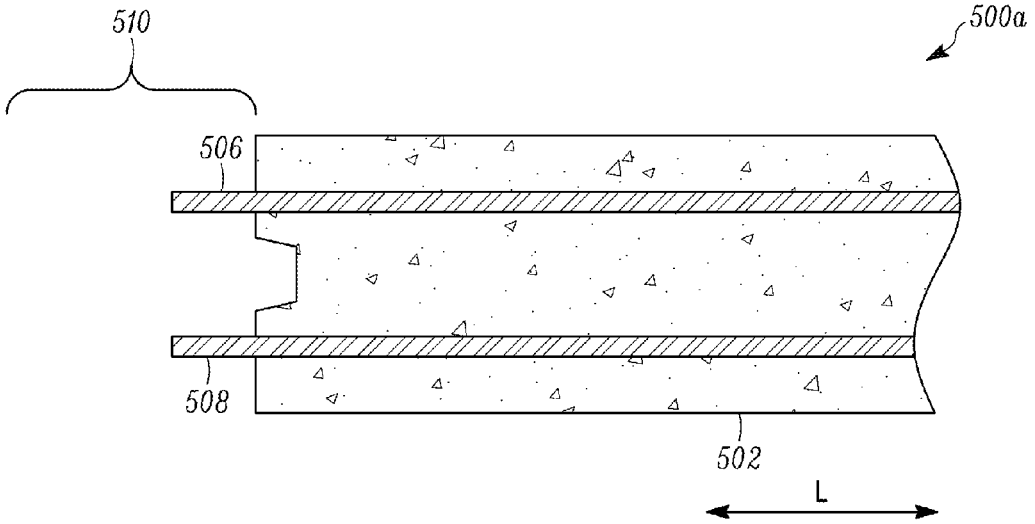
FIGS. 9-14 show schematic side views of floor constructions being constructed according to an embodiment of the process.

FIG. 9 shows the floor construction 500*a*, wherein a first concrete slab 502 is formed with rebars 506, 508 therein (see step 402 in the process 400 of FIG. 8). End portions of the rebars 506, 508 are positioned to extend beyond the first concrete slab 502 at a location 510 where a gap will exist when a second concrete slab is formed.

Figure 10:
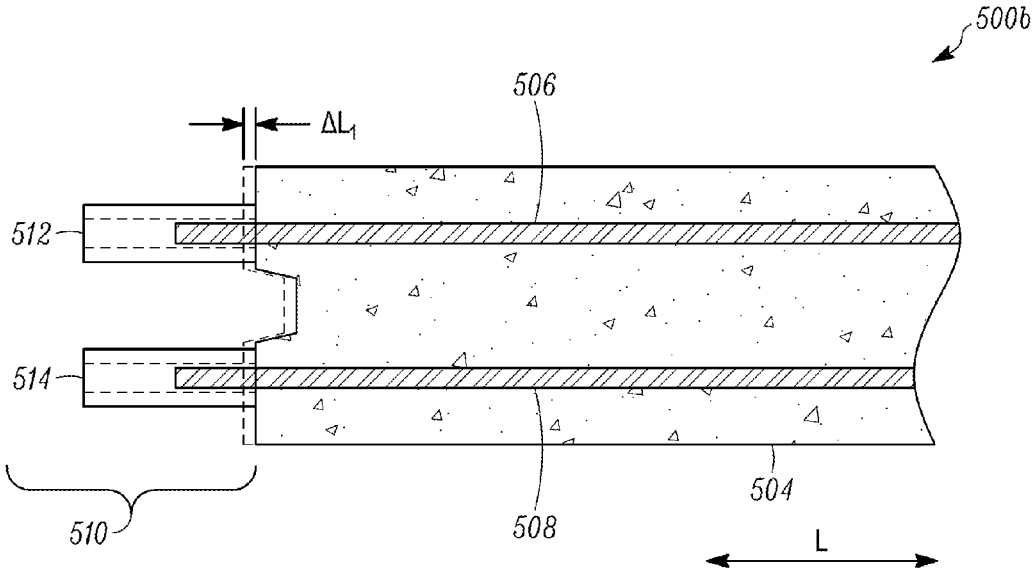

FIG. 10 shows the floor construction 500*b*, wherein the first concrete slab (502 shown in FIG. 9) has been tensioned and has become a first post-tensioned concrete slab 504. The volume of the first post-tensioned concrete slab 504 has changed from the volume of the first concrete slab (502 shown in FIG. 9), and a length of the first concrete slab along the length direction of the rebars 506, 508 has been reduced by the tensioning, indicated by $\Delta L_1$. Near or at the ends of the rebars 506, 508 at the location 510 where the gap will exist when a second concrete slab is formed, splice devices 512, 514 are positioned at the ends of the rebars 506, 508 (see step 404 in the process 400 of FIG. 8).

Figure 11:
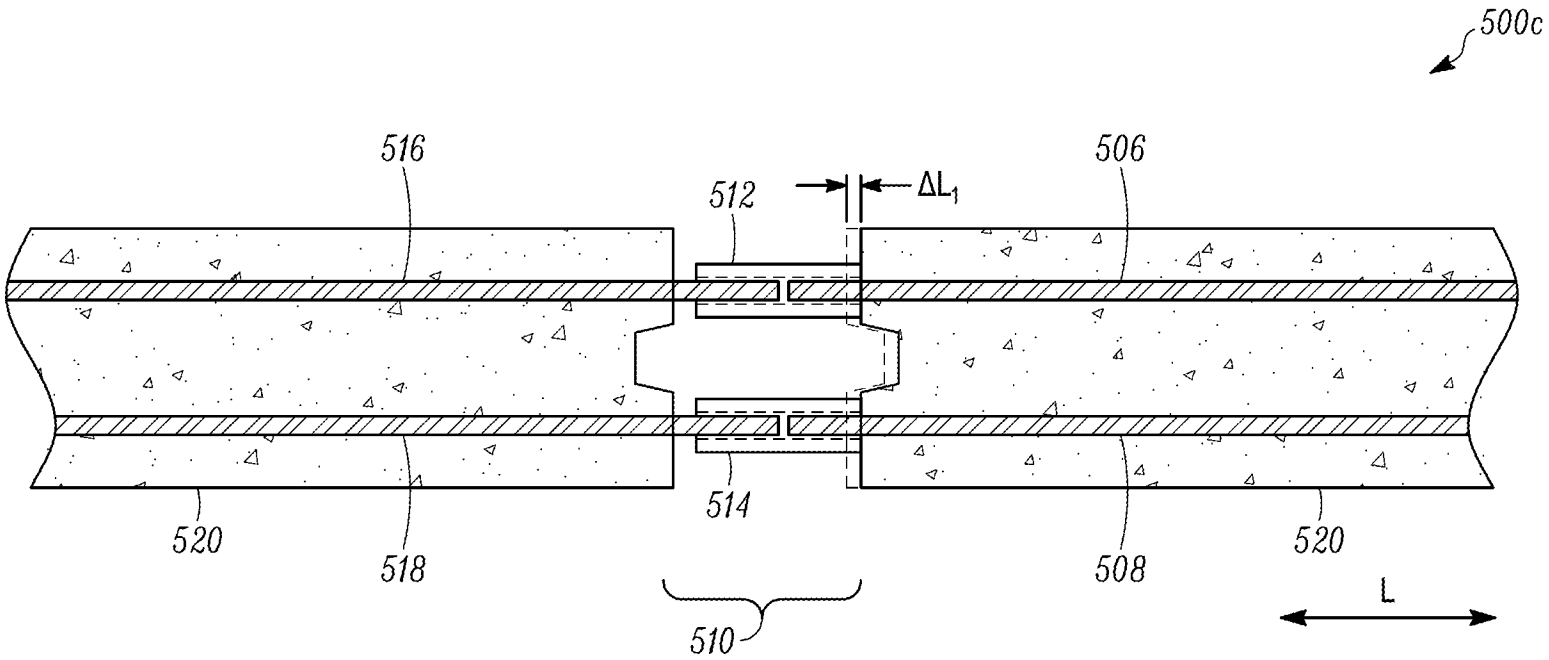

FIG. 11 shows the floor construction 500*c*, wherein additional rebars 516, 518 of the second concrete slab 520 are positioned in the location 510, and also positioned with respect to the respective splice devices 512, 514 (see step 406 in the process 400 of FIG. 8). The rebars 516, 518 can be aligned in a length direction of the rebars 506, 508 guided by the splice devices 512, 514. The second concrete slab 520 is formed to include the rebars 516, 518 (see step 408 in the process 400 of FIG. 8).

Figure 12:
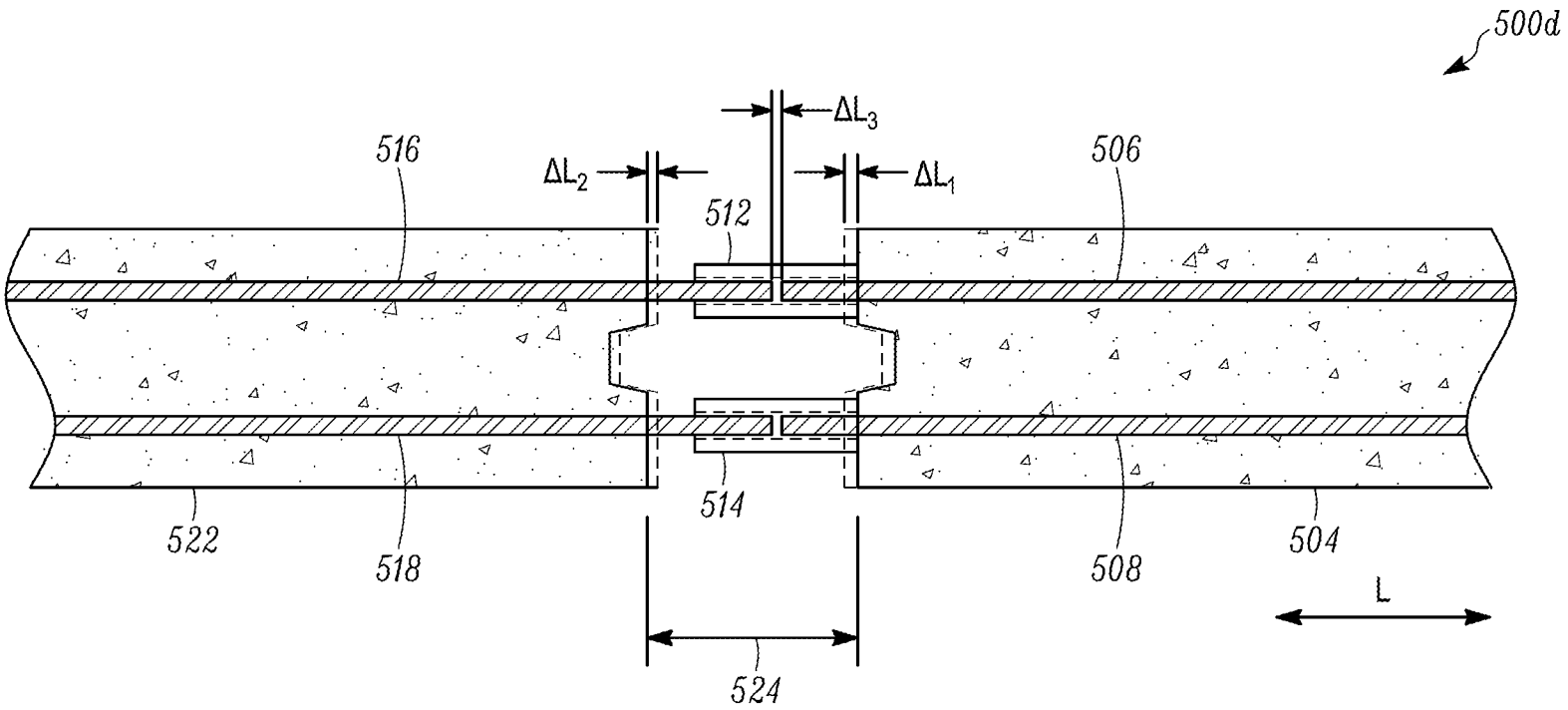

FIG. 12 shows the floor construction 500*d*, wherein the second concrete slab (520 shown in FIG. 11) has been tensioned to become a second post-tensioned concrete slab 522. Thus, the volume of the second post-tensioned concrete slab 522 has changed from the volume of the second concrete slab (520 shown in FIG. 11), and a length of the second concrete slab along the length direction of the rebars 516, 518 has been reduced by the tensioning, indicated by $\Delta L_2$. Near or at the ends of the rebars 516, 518 at the location 510 where the gap now exists, the splice devices 512, 514 are not secured to the rebars 516, 518. Thus, during the change in volume and length of the second concrete slab, the rebars 516, 518 are allowed to move with respect to the splice device 512, 514 (see step 410 in the process 400 of FIG. 8). For example, as the length of the second concrete slab is reduced, thus lengthening the location 510 between the first post-tensioned concrete slab 504 and the second post-tensioned concrete slab 520, the rebars 516, 518 may move (e.g., slide) away from the respective splice devices 512, 514 in the direction of the length change indicated by $\Delta L_3$. In the embodiments, $\Delta L_2$ is equal to, the same as, or substantially similar to $\Delta L_3$. The length change $\Delta L_3$ does not move the end portion of the rebars 516, 518 so much that the length change $\Delta L_3$ prevents the rebars 516, 518 from being connected and/or fixedly secured to the respective splice devices 512, 514. This prevention is predetermined in the positioning of the rebars 516, 518, for example, in step 406 in the process 400 of FIG. 8, and/or structural features included in the splice devices 512, 514.

After the volume change due to tensioning has been completed and the second post-tensioned concrete slab 522 has formed, the gap 524 between the first post-tensioned concrete slab 504 and the second post-tensioned concrete slab 522 is substantially defined. The gap 524 is preferably less than a foot in distance between the ends of the first post-tensioned concrete slab 504 and the second post-tensioned concrete slab 522. However, it is required that the minimum distance of the gap 524 is the length of the splice device (e.g., 512, 514 shown in FIG. 13) that will be used in the gap 524.

Figure 13:
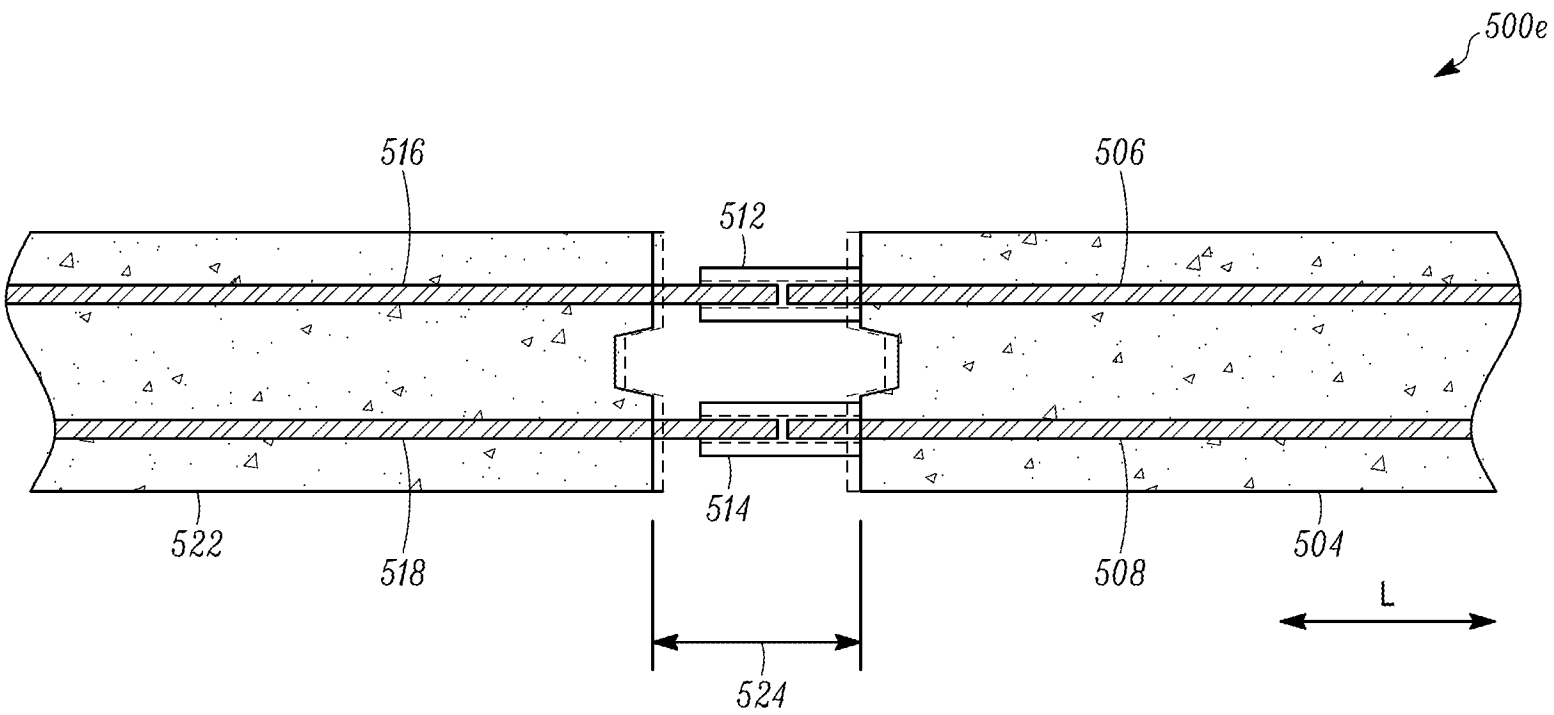

FIG. 13 shows the floor construction 500*e*, wherein the splice devices 512, 514 have been positioned at the end portions of the respective rebars 506, 508, 516, 518, and the splice devices 512, 514 have been securely connected to the end portions of the respective rebars 506, 508, 516, 518 (see step 412 in the process 400 of FIG. 8). The connection (e.g., fixedly securing) can be made by mechanical means (e.g., frictional engagement). The connection can be completed by filling one or more internal chamber of each of the splice devices 512, 514 that contain the respective end portions of the rebars 506, 508, 516, 518 with grout material thus securely binding the end portions of the respective rebars 506, 508, 516, 518 to the splice devices 512, 514. After the grout material fills in the internal chamber of each of the splice devices 512, 514, the respective rebars 506, 508, 516, 518 are connected securely to the respective splice device 512, 514. Each of the splice devices 512, 514 provides structural integrity to the floor construction 500*e*. Thus, the splice devices 512, 514 become the force and/or tension transferring devices. That is, force and/or tension can be transferred through the splice devices 512, 514 to and/or from the respective rebars 506, 508, 516, 518 connected thereto. Preferably, the grout material is stronger than the concrete slab. An embodiment of the splice devices 512, 514 has a length of about twelve (12) inches. In other embodiments, the splice devices 512, 514 have lengths ranging from six (6) inches to twelve (12) inches.

The floor construction 500*e* is positioned substantially horizontal with respect to the earth, and the floor construction 500*e* includes the first post-tensioned concrete slab 504 and the second post-tensioned concrete slab 522 separated by the gap 524. In the gap 524 space, the splice device 512 is connected and/or secured to both rebars 506, 516. Also in the gap 524 space, the splice device 514 is connected and/or secured to both rebars 508, 518. The splice devices 512, 514 are secured to the respective rebars 506, 508, 516, 518 with sufficient strength for structural applicability for connecting the two post-tensioned concrete slabs 504, 522 for structural purposes.

Figure 14:
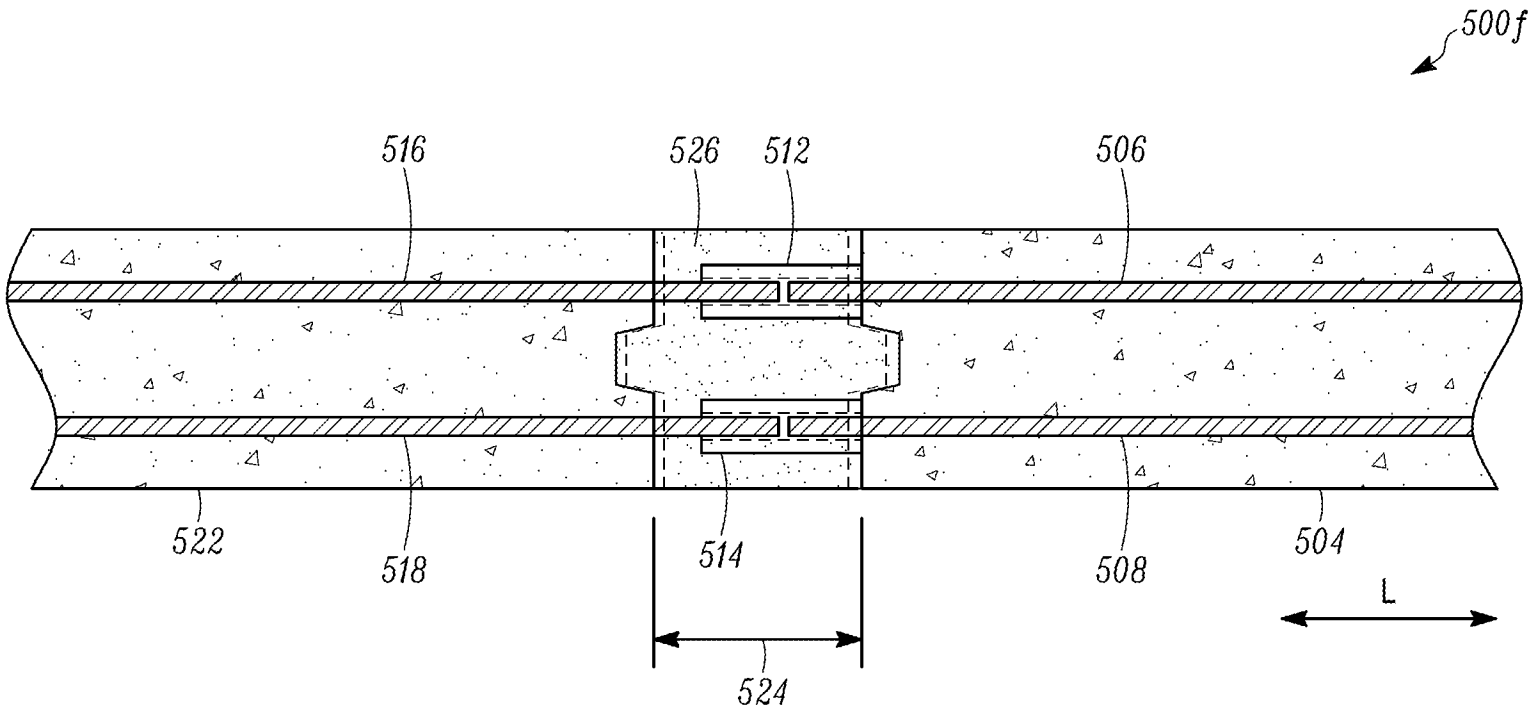

FIG. 14 shows the floor construction 500*f*, wherein the gap 524 has been filled in with a material to form a pour strip 526 (see step 414 in the process 400 of FIG. 8). The pour strip 526 covers the splice devices 512, 514. It is preferable that the splice devices 512, 514 positioned in the gap 524 are completely covered by the pour strip 526.

Figure 15:
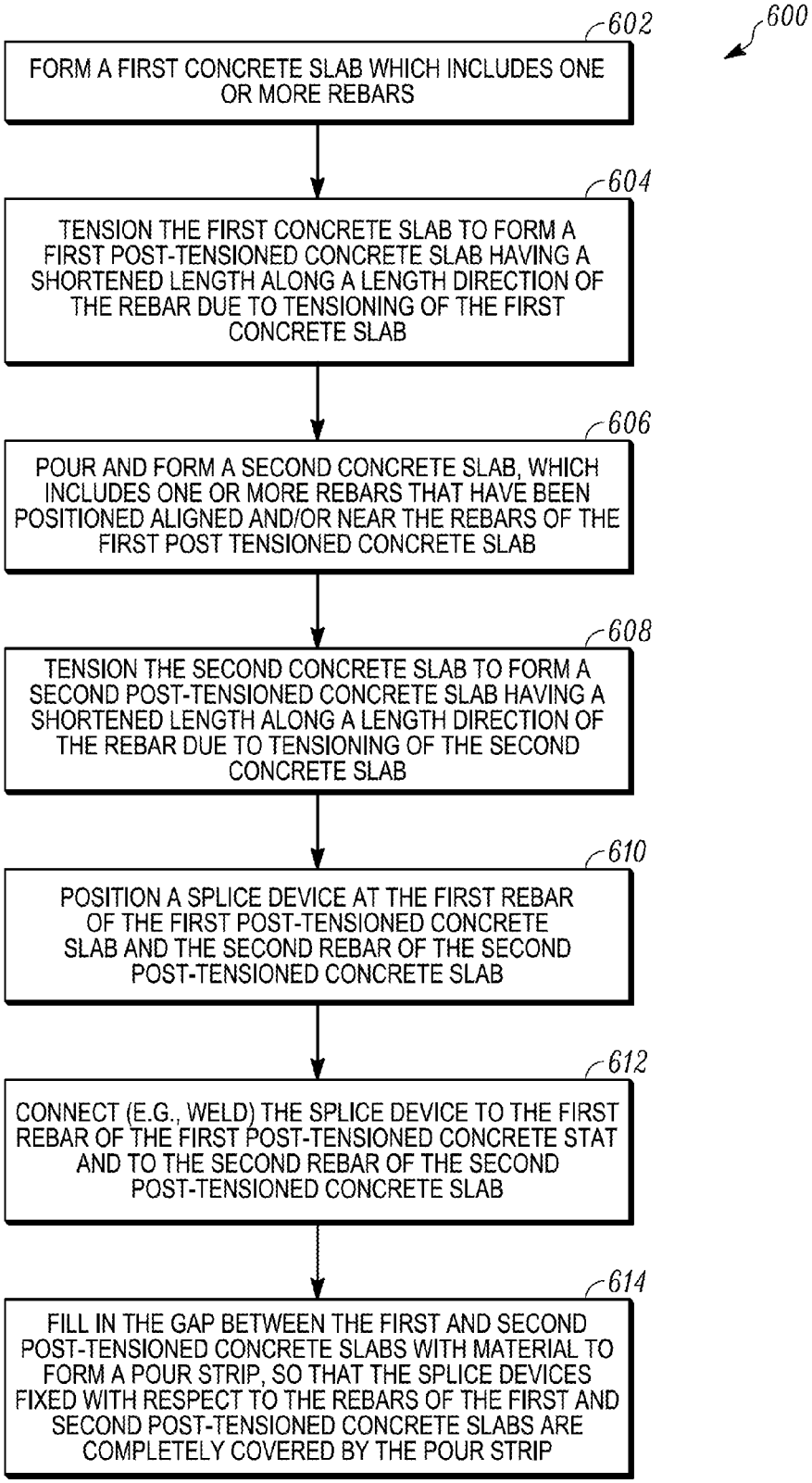
FIG. 15 shows a flow chart of an embodiment of a process for constructing the floor construction with reduced gap design.

FIG. 15 shows a flow chart of an embodiment of a process 600 for constructing the floor construction with reduced gap design. The process includes a step 602 of forming a first concrete slab for post-tensioning, wherein the first concrete slab includes one or more rebars. Ends of the rebars are positioned to extend out from an edge of the first slab. It is preferable that these ends of the rebars do not extend more than six inches beyond the edge of the first slab. The process includes not positioning at this time a splice device at the end of the rebar. Accordingly, a splice device is not positioned at each of the ends of the rebars that are exposed in the gap. Then, in step 604, the first concrete slab is tensioned forming a first post-tensioned concrete slab.

The process 600 includes a step 606 of pouring and forming the second concrete slab. The rebars for the second concrete slab are positioned so that their ends are positioned near respective ends of the respective rebars of the first post-tensioned concrete slab. For example, the ends of the rebars of the second concrete slab are positioned so that the rebars of the second concrete slab are generally in line with the respective rebars of the first post-tensioned concrete slab. It is preferable that the positioning of the rebars for the second concrete slab with respect to the splice devices are done after the first concrete slab has been tensioned (e.g., using the wire strand system that is included in the first concrete slab) and has gone through the volume change, becoming the first post-tensioned concrete slab. Thus, the positioning of the rebars for the second concrete slab can be done with a desired gap space distance in mind. That is, after the first post-tensioned concrete slab has formed, the length change along the length direction of the rebars would have been completed. It is preferable that the gap distance is less than a foot. Further, at this stage in the process 600, the splice devices are not yet positioned where the gap between the first and second concrete slabs will exist when the second concrete slab is formed.

Then, in step 608, the second concrete slab is allowed to shorten along the length direction of the rebar by and due to tensioning of a wire strand system in the second concrete slab. Because the rebars for the second concrete slab can and do move with respect to the respective ends of the rebars of the first post-tensioned concrete slab during the tensioning of the second concrete slab.

After the volume changes due to tensioning of the second concrete slab has been completed, the second concrete slab is the second post-tensioned concrete slab. The process 600 includes a step 610 of positioning a splice device at one end portion of the rebar of the first post-tensioned concrete slab and at one end portion of the rebar of the second post-tensioned concrete slab. Then, in step 612, the splice device is connected to the end portions of the rebars. Preferably, the two rebus that are connected to the splice device are generally in line with each other. Carrying out the connection step 612 can depend on the particular features of the splice device used, as shown in examples in FIGS. 20, 21, and 27. For example, the splice device can be welded to one or more of the rebars.

At this stage in the process, the gap between the first post-tensioned concrete slab and the second post-tensioned concrete slab is generally fixed. Accordingly, the gap distance is generally known. The gap distance of three feet or less is possible. Preferably, the gap distance is one foot or less.

The process 600 includes a step 614 of filling in the gap between the first and second post-tensioned concrete slabs with material to form a pour strip. When the pour strip is formed in the gap, the splice devices connected to the rebars of the first and second post-tensioned concrete slabs are covered by the pour strip. It is preferable that the splice devices positioned in the gap are completely covered by the pour strip.

FIGS. 16-20 and 22 show schematic side views of floor constructions 700*a-f*, respectfully, being constructed according to the process 600 described above and shown in FIG. 15. Like elements are referred to with the same reference numerals.

Figure 16:
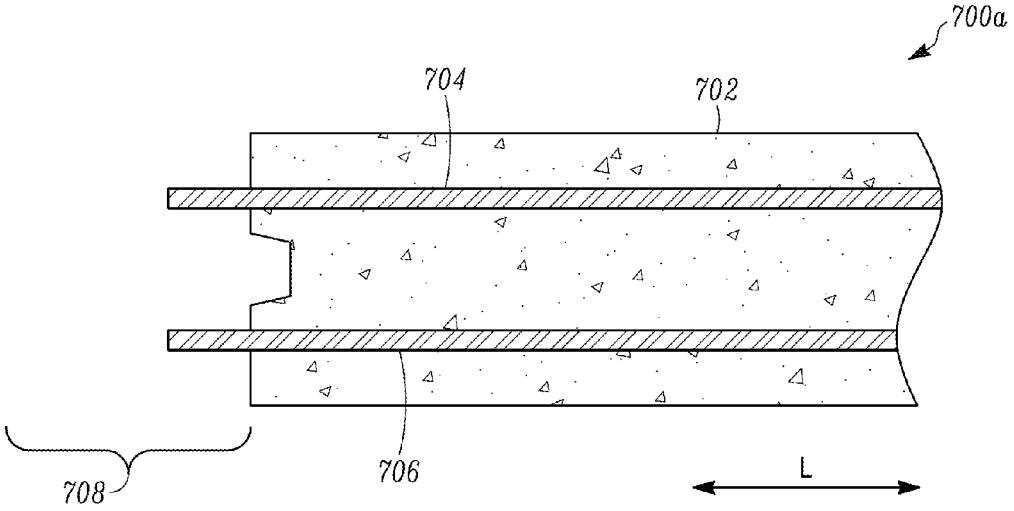
FIGS. 16-20 and 22 show schematic side views of floor constructions being constructed according to an embodiment of the process.

FIG. 16 shows the floor construction 700*a*, wherein a first concrete slab 702 is formed with rebars 704, 706 therein (see step 602 in the process 600 of FIG. 15). End portions of the rebars 704, 706 are positioned to extend beyond the first concrete slab 702 at a location 708 where a gap will exist when a second concrete slab is formed.

Figure 17:
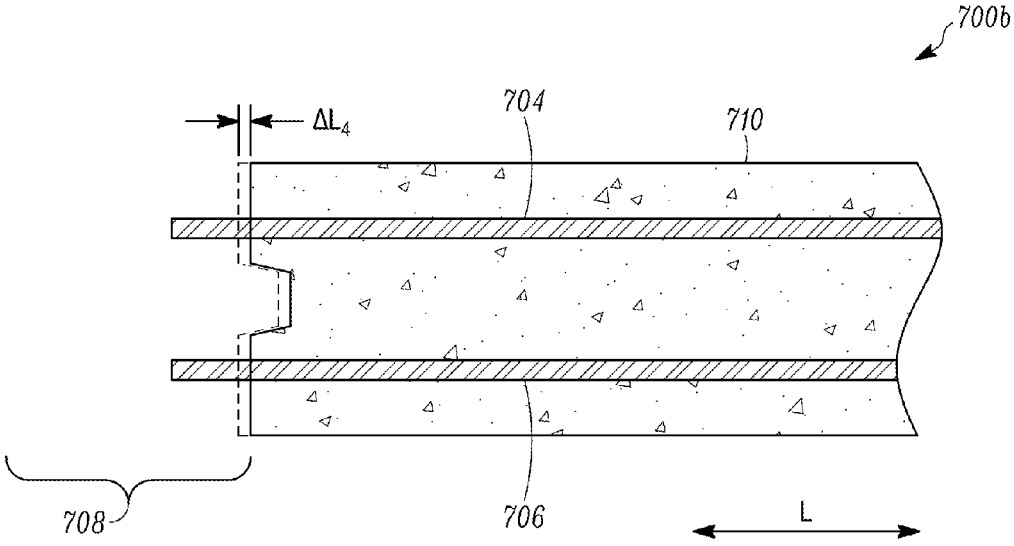

FIG. 17 shows the floor construction 700*b*, wherein the first concrete slab (702 shown in FIG. 16) has been tensioned and has become a first post-tensioned concrete slab 710 (see step 604 in the process 600 of FIG. 15). The volume of the first post-tensioned concrete slab 710 has changed from the volume of the first concrete slab (702 shown in FIG. 16), and a length of the first concrete slab along the length direction of the rebars 704, 706 has been reduced by the tensioning, indicated by $\Delta L_4$. Near or at the ends of the rebars 704, 706 at the location 708 where the gap will exist when a second concrete slab is formed, a splice device is not yet positioned at the ends of the rebars 704, 706.

Figure 18:
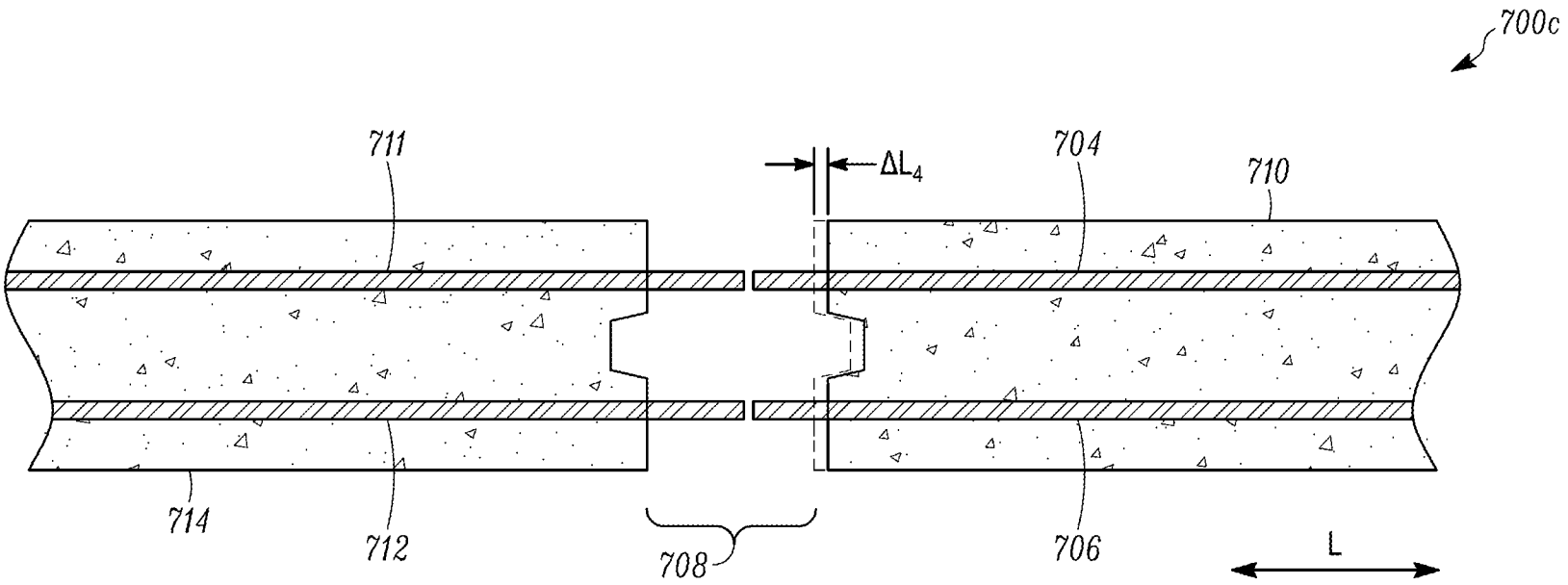

FIG. 18 shows the floor construction 700*c*, wherein additional rebars 711, 712 of the second concrete slab 714 are positioned so that the respective ends of the rebars 711, 712 are in the location 708, and also positioned near ends of the respective rebars 704, 706 of the first post-tensioned concrete slab 710. The rebars 711, 712 are generally in line with length directions of the rebars 704, 706. The second concrete slab 520 is poured and formed (see step 606 in the process 600 of FIG. 15).

Figure 19:
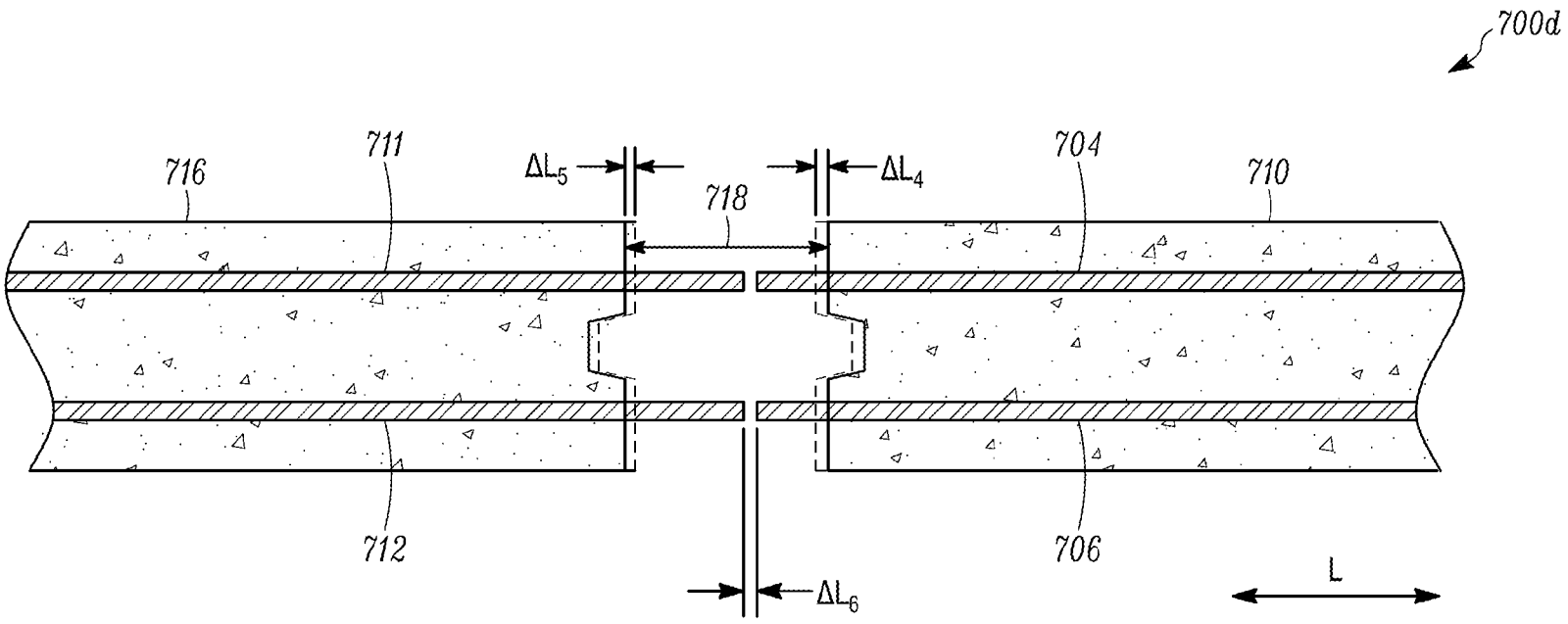

FIG. 19 shows the floor construction 700*d*, wherein the second concrete slab (714 shown in FIG. 18) has been tensioned and has become a second post-tensioned concrete slab 716. Thus, the volume of the second post-tensioned concrete slab 716 has changed from the volume of the second concrete slab (714 shown in FIG. 18), and a length of the second concrete slab along the length direction of the rebars 711, 712 has been reduced by the tensioning, indicated by $\Delta L_6$. Near the ends of the rebars 711, 712 a gap 718 between the first and second post-tensioned concrete slabs 710, 716 now exists. There are no splice devices positioned at the rebars 704, 706, 711, 712, yet.

During the change in volume and length of the second concrete slab, the rebars 711, 712 are allowed to move with respect to the rebars 704, 706 (see step 608 in the process 600 of FIG. 15). As the length of the second concrete slab is reduced, the location 708 between the slabs lengthens forming the gap 718. The rebars 711, 712 may move (e.g., slide) away from the respective rebars 704, 706 in the direction of the length change indicated by $\Delta L_6$. The shortening distance $\Delta L_5$ can be equal to, substantially be the same as, or substantially similar to $\Delta L_6$. The shortening distance $\Delta L_5$ can be different from $\Delta L_6$.

After the volume change due to tensioning has been completed and the second post-tensioned concrete slab 716 has formed, the gap 718 between the first post-tensioned concrete slab 710 and the second post-tensioned concrete slab 716 is substantially defined. The gap 718 is preferably less than a foot in distance. However, the minimum distance of the gap 718 must be the length of the splice device (e.g., 720, 722 shown in FIG. 20) that will be used in the gap 718. For example, the splice device (e.g., 720, 722 shown in FIG. 20) can have a length of from six (6) inches to twelve (12) inches.

Figure 20:
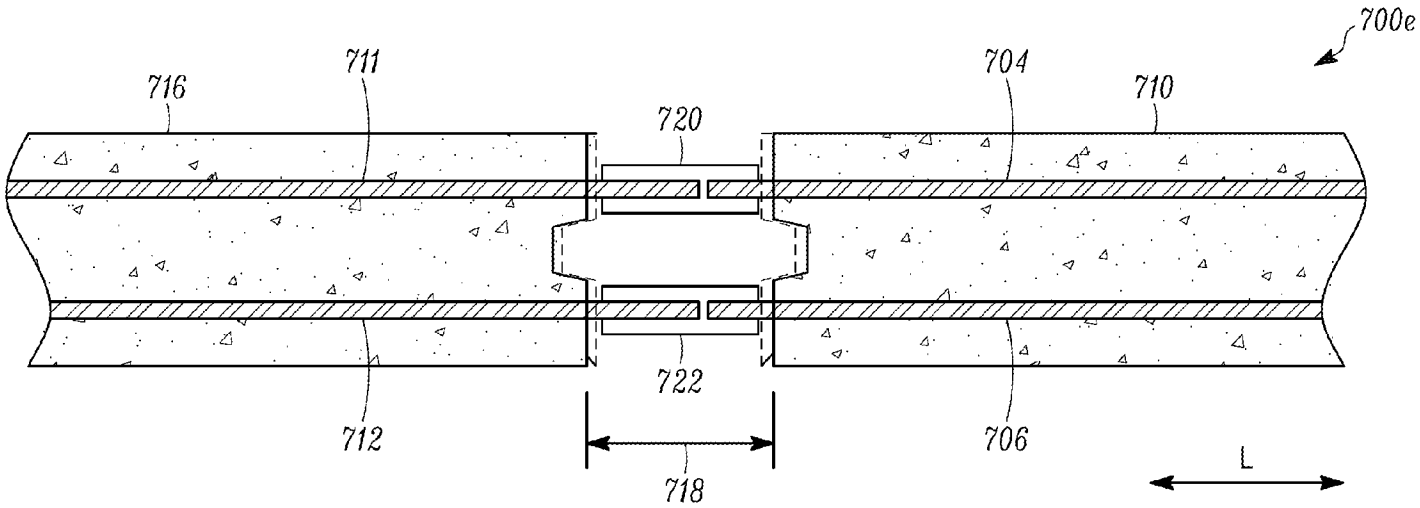

FIG. 20 shows the floor construction 700*e*, wherein the splice devices 720, 722 have been positioned at the end portions of the respective rebars 704, 706, 711, 712 (see step 610 of the process 600 in FIG. 15).

The splice devices 720, 722 are then securely connected to the rebars 704, 706, 711, 712 (see step 612 of the process 600 in FIG. 15). For example, the splice devices 720, 722 can be welded to the rebars 704, 706, 711, 712.

Figure 21:
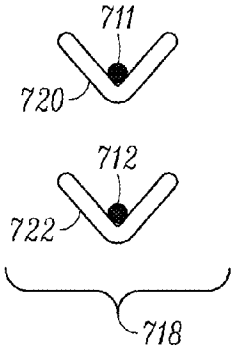
FIG. 21 shows a cross-sectional view of the floor construction shown in FIG. 20.

FIG. 21 shows a cross-sectional view in the gap portion of the floor construction 700*e* shown in FIG. 20. The splice devices 720, 722 include a substantially "V-shaped" cross section for providing at least one, preferably two, surfaces for welding each of the respective rebars 704, 706, 711, 712.

The floor construction 700*e* is positioned substantially horizontal with respect to the earth. In the gap 718, the splice devices 720, 722 are secured to the respective rebars 704, 706, 711, 712 with sufficient strength for structural applicability for connecting the two post-tensioned concrete slabs 710, 716 for structural purposes.

Figure 22:
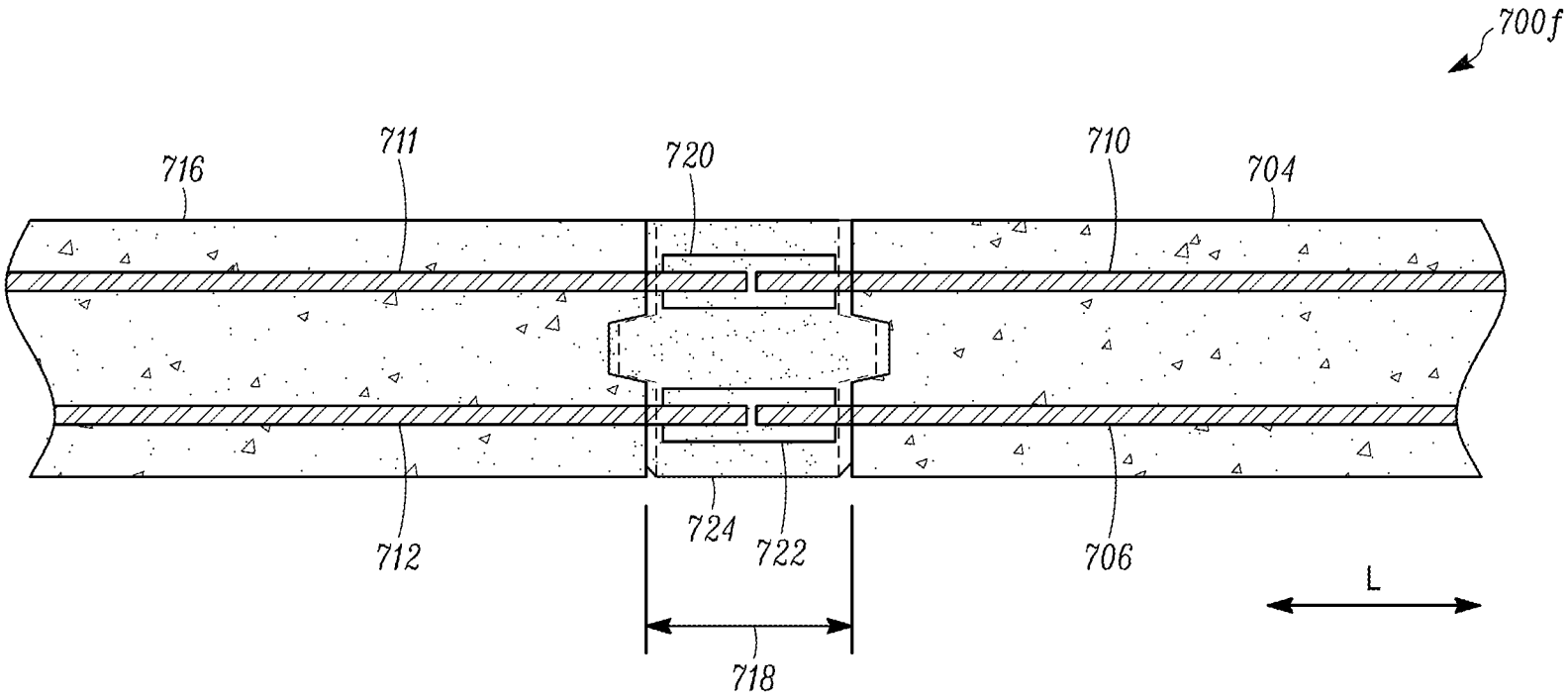

FIG. 22 shows the floor construction 700*f*, wherein the gap 718 has been filled in with a material to form a pour strip 724 (see step 614 in the process 400 of FIG. 15). The pour strip 724 covers the splice devices 720, 722. It is preferable that the splice devices 720, 722 positioned in the gap 718 are completely covered by the pour strip 724.

Applications of the embodiments disclosed herein include all aspects of construction, including, but not limited to, buildings, towers, floating terminals, ocean structures and ships, storage tanks, nuclear containing vessels, bridge piers, bridge ducts, foundation soil anchorages, and virtually all other types of installations where normally reinforced concrete may be acceptable.

Preferred embodiments have been described. Those skilled in the art will appreciate that various modifications and substitutions are possible, without departing from the scope of the invention as claimed and disclosed, including the full scope of equivalents thereof.

What is claimed is:

1. A concrete construction, comprising: a first post-tensioned concrete slab and a second post-tensioned concrete slab, said first post-tensioned concrete slab and said second post-tensioned concrete slab having respective upper surfaces that are generally aligned, said first post-tensioned concrete slab including a first rebar installed therein, said first post-tensioned concrete slab being post-tensioned in at least a direction substantially parallel to said first rebar, said second post-tensioned concrete slab including a second rebar installed therein, said second post-tensioned concrete slab being post-tensioned in at least a direction substantially parallel to said second rebar, said first post-tensioned concrete slab and second post-tensioned concrete slab being separated by a gap so that the concrete material of said first post-tensioned concrete slab is not in contact with the concrete material of said second post-tensioned concrete slab, said construction further including a splice device positioned in the gap for connecting to a portion of the first rebar and to a portion of the second rebar.

2. The concrete construction according to claim 1, wherein said splice device includes a cavity that contains said portion of the second rebar.

3. The concrete construction according to claim 2, wherein said cavity also contains said portion of the first rebar.

4. The concrete construction according to claim 1, wherein said splice device is attached to said portion of the first rebar.

5. The concrete construction according to claim 1, wherein said splice device is connected to said end portion of the first rebar at an end of said splice device, wherein said end has a threaded surface which mates with a threaded surface of said end portion of the first rebar.

6. The concrete construction according to claim 1, wherein said splice device is connected to said first rebar by a weld.

7. The concrete construction according to claim 6, wherein said splice device is connected to said second rebar by a weld.

8. The concrete construction according to claim 1, wherein said gap has a longer dimension for one side-to-side and a shorter dimension for another side-to-side, said shorter dimension being three feet or less, said shorter dimension being shorter relative to said longer dimension.

9. The concrete construction according to claim 1, wherein said gap has a longer dimension for one side-to-side and a shorter dimension for another side-to-side, said shorter dimension being twelve (12) inches or less and being shorter relative to said longer dimension.

10. The concrete construction according to claim 1, further comprising:

a strip of non-shrink material being in the gap, wherein said strip has a compressive strength that is greater than or equal to a compressive strength of the concrete material of said first and second post-tensioned concrete slabs, and the strip of non-shrink material completely surrounds the splice device.

11. A concrete construction, comprising: a first post-tensioned concrete slab and a second post-tensioned concrete slab, said first post-tensioned concrete slab and said second post-tensioned concrete slab having respective upper surfaces that are generally aligned, said first post-tensioned concrete slab including a first rebar installed therein, said first post-tensioned concrete slab being post-tensioned in at least a direction substantially parallel to said first rebar, said second post-tensioned concrete slab including a second rebar installed therein, said second post-tensioned concrete slab being post-tensioned in at least a direction substantially parallel to said second rebar, said first post-tensioned concrete slab and second post-tensioned concrete slab being separated by a gap so that the concrete material of said first post-tensioned concrete slab is not in contact with the concrete material of said second post-tensioned concrete slab, said construction further including:

a splice device positioned in the gap connecting an end portion of the first rebar and an end portion of the second rebar; and a strip of non-shrink material being in the gap and completely surrounding said splice device, wherein said strip has a compressive strength that is greater than or equal to a compressive strength of the concrete material of said first and second post-tensioned concrete slabs, said strip having a longer dimension for one side-to-side and a shorter dimension for another side-to-side, said shorter dimension being three feet or less and being shorter relative to said longer dimension.

12. A method for making a concrete construction including a first post-tensioned concrete slab and a second post-tensioned concrete slab separated by a gap, comprising:

forming said first post-tensioned concrete slab, wherein said first post-tensioned concrete slab includes a first rebar installed therein, said first post-tensioned concrete slab being post-tensioned in at least a direction substantially parallel to said first rebar;

prior to pouring a second concrete slab, positioning a second rebar for said second concrete slab so that a portion of said second rebar is generally in line with a portion of said first rebar;

pouring said second concrete slab;

forming a second post-tensioned concrete slab by tensioning said second concrete slab in at least a direction substantially parallel to said second rebar, thus forming said gap between said first post-tensioned concrete slab and said second post-tensioned concrete slab, wherein said gap has a longer dimension for one side-to-side and a shorter dimension for another side-to-side, said shorter dimension being shorter relative to said longer dimension;

after forming said second post-tensioned concrete slab, positioning a splice device to contact both a portion of said first rebar and a portion of said second rebar; and securely connecting the splice device to said portion of said first rebar and said portion of said second rebar.

13. The method according to claim 12, wherein said shorter dimension being twelve (12) inches or less in length.

14. A method for making a concrete construction including a first post-tensioned concrete slab and a second post-tensioned concrete slab, comprising:

forming said first post-tensioned concrete slab, wherein said first post-tensioned concrete slab includes a first rebar installed therein, said first post-tensioned concrete slab being post-tensioned in at least a direction substantially parallel to said first rebar;

before a second post-tensioned concrete slab has been formed, positioning a splice device at an end portion of the first rebar, but not securely connecting said splice device to the end portion of the first rebar;

before the second post-tensioned concrete slab has been formed, positioning an end portion of a second rebar inside a chamber of said splice device, but not securely connecting said splice device to the end portion of the second rebar;

forming said second post-tensioned concrete slab so that said second rebar is installed therein, said second post-tensioned concrete slab being post-tensioned in at least a direction substantially parallel to said second rebar, wherein said first post-tensioned concrete slab and second post-tensioned concrete slab are separated by a gap so that the concrete material of said first post-tensioned concrete slab is not in contact with the concrete material of said second post-tensioned concrete slab, and said end portion of said second rebar is allowed to move with respect to the splice device during the creating of said second post-tensioned concrete slab; and securely connecting said splice device to said end portion of said first rebar and said end portion of said second rebar.

15. The method according to claim 14, wherein said gap is formed so that said gap has a longer dimension for one side-to-side and a shorter dimension for another side-to-side, said shorter dimension being three feet or less, said shorter dimension being shorter relative to said longer dimension.

16. The method according to claim 14, further comprising: forming a strip of material in said gap with a non-shrink material, wherein said strip has a compressive strength that is greater than or equal to a compressive strength of the concrete material of said first and second post-tensioned concrete slabs.

* * * * *